United States Patent [19]

Miller

[11] 4,091,172

[45] May 23, 1978

[54] UNIFORM GOLD FILMS

[75] Inventor: Richard G. Miller, Pittsburgh, Pa.

[73] Assignee: PPG Industries, Inc., Pittsburgh, Pa.

[21] Appl. No.: 750,474

[22] Filed: Dec. 14, 1976

[51] Int. Cl.[2] ..... C23C 3/02

[52] U.S. Cl. ..... 428/630; 427/168; 427/304; 427/404; 427/426; 428/672

[58] Field of Search ..... 428/434, 630, 669, 672; 427/168, 169, 164, 163, 304, 404, 426

[56] References Cited

U.S. PATENT DOCUMENTS

| | | | |
|---|---|---|---|
| 1,281,262 | 10/1918 | Andres | 428/434 X |
| 2,801,935 | 8/1957 | Owen | 427/169 |
| 2,963,383 | 12/1960 | Weinrich | 427/168 |
| 3,147,133 | 9/1964 | Loiseleur | 428/434 |
| 3,300,328 | 1/1967 | Luce | 428/434 X |
| 3,476,594 | 11/1969 | Soderberg | 427/304 |
| 3,515,571 | 6/1970 | Levy | 428/434 X |
| 4,005,229 | 1/1977 | Miller | 427/304 |

*Primary Examiner*—Ralph S. Kendall
*Attorney, Agent, or Firm*—Donna L. Seidel

[57] ABSTRACT

Uniform gold films having an intense pure gold color and superior abrasion and adhesion properties are prepared by first depositing a gold film on a nonmetallic substrate by a known method, preferably electroless deposition, then depositing a silver film over the gold by electroless deposition.

9 Claims, No Drawings

UNIFORM GOLD FILMS

CROSS-REFERENCE TO RELATED APPLICATIONS

The present invention is a further improvement upon the method disclosed in U.S. Ser. No. 731,053 filed on Oct. 8, 1976, by H. Franz et al. entitled "Improved Electroless Gold Plating Bath."

BACKGROUND OF THE INVENTION

1. Field of the Invention

The present invention relates broadly to the art of electroless deposition of metallic films onto nonmetallic substrates. More particularly, the invention relates to a method for improving the color and durability of gold-coated articles.

2. Description of the Prior Art

In the art of depositing noble metal coatings onto nonmetallic surfaces, U.S. Pat. No. 3,300,328 to Luce discloses an aqueous electroless gold plating bath comprising a gold compound, an ammonium or alkali metal sulphite or meta-bisulphite complexing agent, and a hydrazine or hydroxylamine reducing agent. Gold films are deposited in about 40 minutes at elevated temperatures.

A more rapid method of depositing gold films onto nonmetallic substrates is described by Levy in U.S. Pat. No. 3,515,571. A preferably neutral gold solution is prepared by dissolving in water a gold salt such as gold chloride, and complexing the free gold ions in excess of $10^{-16}$ gram ions per liter with suitable coordinating ligands such as alkali metal carbonates, alkali metal hydroxides, ammonia and amines. Gold films may be deposited on nonmetallic substrates in about one minute at ambient temperatures by contacting a receptive surface with the above gold solution and a second solution of a hydrazine reducing agent. Levy suggests the use of the resultant gold coated articles as conductors, electrodes, and mirrors.

U.S. Pat. No. 3,484,263 to Kushihashi et al. discloses a method for forming a homogeneous semi-transparent gold coating on glass. The method involves contacting a sensitized glass surface with an alkaline aqueous solution of a gold salt, a reducing agent and an alkali carbonate to promote reduction at a temperature not to exceed 10° C. After about 0.5 to 5 minutes contact, the contacting interface is subjected to radiation of 2500 – 5000 Angstroms to reduce the gold salt to a gold coating with a thickness of 150 – 500 Angstroms.

In U.S. Ser. No. 731,053, filed on Oct. 8, 1976, Franz et al., disclose an improved method for depositing uniform gold films by contacting a receptive nonmetallic substrate with a solution of complexed gold ions and a reducing agent. The improvement involves preparing the gold solution by adding a concentrated solution of a gold salt to a concentrated solution of a complexing agent with heating. A further improvement involves using sodium carbonate as the complexing agent and buffering the gold solution with sodium bicarbonate.

SUMMARY OF THE INVENTION

The present invention provides a method for producing gold coated articles having a more intense pure gold color and superior abrasion and adhesion properties compared with gold coated articles prepared according to previously known methods.

A uniform gold film is deposited on a receptive nonmetallic substrate. For example, a glass sheet is cleaned, sensitized and activated by methods common in the art of electroless deposition and a gold film is deposited by contacting the surface with a solution of gold ions and a reducing agent. According to the present invention, the gold coated article is then contacted with a solution of silver ions and a reducing agent to deposit a silver film over the gold film resulting in a coated article having a more intense pure gold color and superior abrasion and adherence properties compared with an article coated with only a gold film.

DETAILED DESCRIPTION OF THE PREFERRED EMBODIMENTS

Sheets of glass, particularly soda-lime-silica glass having a thickness of about 7/32 inch, are prepared for coating. First, the surface to be coated is cleaned, preferably by a blocking operation carried out with rotating felt blocks which gently abrade the surface with an aqueous slurry of a commercial cleaning compound. A suitable continuous line apparatus for washing, rinsing and sweeping the surface is shown in U.S. Pat. No. 3,723,158 to Miller et al.

After the surface to be coated is cleaned, it is contacted with a dilute aqueous solution of a sensitizing agent, preferably stannous chloride. After a brief period of contact under ambient conditions, the sheet is rinsed, preferably with deionized water, and activated. Activation may be accomplished by contacting the sensitized surface with a solution of silver ions and a reducing agent to deposit a thin catalytic silver film of such thickness as lowers the luminous transmittance of the sheet to about 60 percent or less. However, the preferred method of activation is to contact the sensitized surface with a dilute solution of palladium chloride.

After the sheet is rinsed, a gold film is deposited on the activated surface. In a most preferred embodiment, a gold solution is used which comprises about 1 to 6 grams per liter gold chloride and about 6 to 36 grams per liter sodium carbonate prepared according to the method disclosed in U.S. Ser. No. 731,053, filed on Oct. 8, 1976, by Franz et al. entitled "Improved Electroless Gold Plating Bath" which disclosure is incorporated herein by reference. Hydrazine reducing agents are preferred, particularly hydrazine tartrate in solutions of about 0.5 to 5 grams per liter. A surfactant, for example sodium dodecylbenzene sulfonate, may be added to a solution of the reducing agent to enhance the uniformity of the gold film.

The gold film is deposited by contacting the activated surface of the substrate substantially simultaneously with separate solutions of complexed gold ions and a reducing agent. A preferred method is a spray method employing a double nozzled spray gun. Sufficient gold is deposited to lower the luminous transmittance of the sheet to about 39 to 44 percent for preferred articles of the present invention.

Following deposition of the gold film, the surface is rinsed and a silver film is deposited over the gold film. A preferred method is again a spray method employing a double nozzled spray gun to contact the gold coated surface substantially simultaneously with a silver solution and a reducing solution. The silver solution is preferably an alkaline aqueous solution comprising about 0.15 to 15 grams, preferably about 0.5 to 5 grams, per liter of silver nitrate and about 0.45 to 60 milliliters, preferably about 1.5 to 20 milliliters, per liter of ammonium hydroxide (28 to 30 percent aqueous solution). The reducing solution comprises about 0.5 to 10 grams per liter of reducing agent, preferably about 1 to 2 grams per liter dextrose.

Sufficient silver is deposited over the gold to achieve the desired final luminous transmittance. A preferred article, according to the present invention, for use in architectural glazing applications has a final luminous transmittance of about 20 percent. The preferred article has a more intense pure gold color and superior durability compared with an article similarly produced with only a gold film.

The present invention will be further understood from the descriptions of specific examples which follow.

EXAMPLE I

Glass sheets are cleaned using an aqueous slurry of cerium oxide and a felt block. The surface to be coated is rinsed thoroughly, sensitized with a dilute aqueous solution of stannous chloride, and rinsed again. The sensitized surface is then activated with a dilute solution of palladium chloride and rinsed once more.

The activated surface is coated with a gold film by spraying through a double nozzled spray gun a gold solution containing 2 grams per liter chlorauric acid ($HAuCL_4 \cdot 3H_2O$) and 12 grams per liter sodium carbonate ($Na_2CO_3$ anhydrous), and a reducing solution containing 2 grams per liter hydrazine tartrate and 0.02 grams per liter of 60 percent sodium dodecyl benzene sulfonate (available as Richonate 60B from the Richardson Company, Des Plaines, Ill. 60018). The solutions are sprayed until the luminous transmittance of the coated article is approximately 40 percent.

The gold-coated sheet is rinsed thoroughly and coated with a film of silver by spraying simultaneously a silver solution containing 1.25 grams per liter silver nitrate ($AgNO_3$), 0.37 grams per liter sodium hydroxide (NaOH), 3.75 milliliters per liter ammonium hydroxide (28 percent $NH_4OH$), and a reducing solution of 0.63 grams per liter dextrose. The solutions are sprayed until the luminous transmittance of the coated articles is about 20 percent.

The article coated with a gold-silver composite film has a more intense pure gold color and superior abrasion resistance and adherence characteristics compared with articles coated with only a gold film.

EXAMPLE II

Glass sheets ae cleaned, sensitized and activated as in Example I. A solution of 2 grams of gold chloride in 100 milliliters of water is added, with stirring, to a solution of 12 grams of sodium carbonate in 100 milliliters of water maintained at a temperature of about 150° F. The resultant solution is diluted to one liter and buffered at a pH of about 9 by the addition of 30 grams of sodium bicarbonate.

A gold film is deposited as in Example I. The gold coated article is then overcoated with silver to a final luminous transmittance of about 20 percent. The color of the resultant article coated with the silver-over-gold composite film is compared in Table I with the color of an article coated by the same method but with gold only. Tristimulus X, Y and Z values were measured relative to a white standard with a Large Sphere Color-Eye Colorimeter manufactured by Instrument Development Laboratories.

TABLE I

Color-Eye Readings For Silver-Gold Coated Article Compared With Readings For Gold Coated Article

| Reading | Silver-Gold | Gold Only |
|---|---|---|
| Tristimulus X | 70 | 43 |
| Tristimulus Y | 62 | 35 |
| Tristimulus Z | 30 | 18 |

The above examples are offered only to illustrate the present invention. Various modifications which will become known to those skilled in the art are included within the scope of the present invention which is limited only as set forth as follows in the claims.

What is claimed is:

1. In a method for making a gold colored coated article comprising the steps of cleaning and sensitizing a surface of a nonmetallic substrate, depositing thereon a metallic gold film, and coating the gold with a metallic silver film, the improvement which comprises contacting the gold film substantially simultaneously with (a) a solution comprising a silver salt and ammonium hydroxide; and (b) a solution comprising a reducing agent for silver ions to deposit a transparent metallic silver film over the gold film.

2. The improved method according to claim 1, wherein the gold film is deposited by contacting the sensitized surface substantially simultaneously with a first solution comprising a gold salt and a complexing agent and a second solution comprising a hydrazine reducing agent, and the silver film is deposited by contacting the gold coated surface substantially simultaneously with a first solution comprising a silver salt and ammonium hydroxide and a second solution comprising dextrose.

3. The improved method according to claim 1, wherein the gold film is deposited by contacting the sensitized surface substantially simultaneously with:

(a) an aqueous solution comprising from about 1 to about 6 grams per liter gold chloride and from about 6 to about 36 grams per liter sodium carbonate; and (b) an aqueous solution comprising from about 0.5 to about 5 grams per liter hydrazine tartrate and the silver film is deposited by contacting the gold coated surface substantially simultaneously with (a) an aqueous solution comprising from about 0.15 to about 15 grams per liter silver nitrate and from about 0.45 to about 60 milliliters per liter of an aqueous solution of 28 to 30 percent ammonium hydroxide; and (b) an aqueous solution comprising from about 0.5 to about 10 grms per liter dextrose.

4. A method for coating a surface of a transparent glass substrate comprising the steps of:

(a) cleaning the surface;

(b) sensitizing the surface;

(c) activating the surface;

(d) contacting the activated surface substantially simultaneously with:

(1) a solution comprising a gold salt and a complexing agent for gold ions; and (2) a solution comprising a reducing agent for gold ions; to deposit a gold film on the activated surface;

(e) contacting the gold coated surface substantially simultaneously with:

(1) a solution comprising a silver salt and ammonium hydroxide; and (2) a solution comprising a reducing agent for silver ions;

to deposit a silver film over said gold film.

5. The method according to claim 4, wherein the activated surface is contacted with:

(a) an aqueous solution comprising from about 1 to about 6 grams per liter gold chloride and from about 6 to about 36 grams per liter sodium carbonate; and (b) an aqueous solution comprising from about 0.5 to about 5 grams per liter of a hydrazine reducing agent; to deposit a uniform transparent gold film.

6. The method according to claim 5, wherein the gold coated surface is contacted with:

(a) an alkaline aqueous solution comprising from about 0.15 to about 15 grams per liter silver nitrate and from about 0.45 to about 60 milliliters per liter of an aqueous solution of 28 to 30 percent ammonium hydroxide; and (b) an aqueous solution comprising from about 0.5 to about 10 grams per liter reducing agent.

7. The method according to claim 5, wherein the activated surface is contacted with the solutions for sufficient time to deposit a gold film of such thickness that the coated substrate has a luminous transmittance of from about 39 to about 44 percent.

8. The method according to claim 7, wherein the gold coated surface is contacted with:

(a) an alkaline aqueous solution comprising from about 0.5 to 5 grams per liter silver nitrate and from about 1.5 to about 20 milliliters per liter ammonium hydroxide; and (b) an aqueous solution comprising from about 0.5 to 2 grams per liter dextrose;

to deposit over the gold film a silver film of such thickness that the coated substrate has a luminous transmittance of from about 15 to about 25 percent.

9. A gold-colored article prepared according to the method of claim 8.

* * * * *